United States Patent [19]

Ohtsuji et al.

[11] Patent Number: 4,657,475

[45] Date of Patent: Apr. 14, 1987

[54] METHOD FOR POSITIONING SEAMED BALLS

[75] Inventors: Masaru Ohtsuji; Tomonori Itoh, both of Kobe; Takashi Honda, Kakogawa; Shinobu Ando, Toyohashi; Kazumi Matsui, Aichi, all of Japan

[73] Assignee: Sumitomo Rubber Industries, Ltd., Kobe, Japan

[21] Appl. No.: 775,832

[22] Filed: Sep. 13, 1985

[51] Int. Cl.[4] ..... B25J 9/04

[52] U.S. Cl. ..... 414/786; 198/394; 414/754; 414/772; 414/781; 414/783

[58] Field of Search ..... 29/148.4 B; 198/379, 198/394, 395; 273/61 R, 61 B, 61 D; 414/754, 757, 763, 772, 780, 781, 783, 786; 901/47

[56] References Cited

U.S. PATENT DOCUMENTS

| | | | |
|---|---|---|---|
| 3,088,613 | 5/1963 | Wuesthoff | 414/757 X |
| 3,466,514 | 9/1969 | Brunner et al. | 414/754 X |
| 3,932,977 | 1/1976 | Ringler | 273/61 D X |

*Primary Examiner*—Robert J. Spar
*Assistant Examiner*—Janice Krizek
*Attorney, Agent, or Firm*—Birch, Stewart, Kolasch & Birch

[57] ABSTRACT

A method for positioning seamed balls each having an endless curved seam line, comprising steps of: supporting each ball to locate its center at an origin of a three-dimensional orthogonal coordinate consisting of two horizontal axes X, Y and one vertical axis Z; rotating the ball on at least one of the axes X, Y until an optical sensor disposed on the axis Z specifies such a particular locus that intersects the seam line at four points during one full rotation of the ball to provide four arcs along the locus; finding the shortest arc among the four and locating its mid point on the axis Z by rotating the ball on the axis X; rotating the ball on the axis Y so that an intersection of a bisector and a part of the seam line is located on the axis Z; and rotating the ball on the axis Y until a hip center of the ball is located on the axis Z.

7 Claims, 19 Drawing Figures

METHOD FOR POSITIONING SEAMED BALLS

BACKGROUND AND SUMMARY OF THE INVENTION

This invention relates to a method for positioning seamed balls, and more particularly to a method for automatically positioning the seamed balls such as known tennis balls, baseballs and the like, each having a known curved endless seam line which divides an entire ball surface into a pair of identical, dumbbell-like parts, hereinafter referred to as "dumbbell sheet(s)" or "dumbbell(s)", each of which has a pair of identical round hip portions joined by a waist portion which is most reduced at its middle portion.

The term "seamed ball(s)" herein used includes not only such balls as having a real seam line along which the pair of dumbbell sheets are actually joined together but also such balls as having a false seam line formed, for example, by molding, printing, painting or any other process.

In manufacture of the seamed balls each having the above mentioned endless seam line appearing on the external spherical surface thereof, it is necessary to make each of the seamed balls correctly positioned so that a certain predetermined face thereof is directed toward a certain predetermined direction, in order that, as shown in FIG. 1A, a certain commercial indication ID such as a trademark is properly stamped or printed on a constant surface spot of each ball SB, for example on the central surface spot of a waist portion W of one of the dumbbells.

Such ball positioning is also necessary when inspection of compressibility of the seamed balls SB is performed. For example, J. T. A. Standard (the standard of Japan Tennis Association) prescribes that the inspection of compressibility should be carried out by applying a certain compressive pressure onto a central surface spot C1 (hereinafter referred to as "hip center") of one of the hip portions H of the dumbbell as shown in FIG. 1B or a central surface spot C2 (hereinafter referred to as "waist center") of the waist portion W of the dumbbell as shown in FIG. 1C.

Therefore, there exists a strong demand for a method for an apparatus which enables the automatic positioning of the seamed balls. In fact, however, no satisfactory technique therefor is available at present. Although an attempt to utilize a known image sensor to realize such automatic ball positioning was once proposed, it turned unsuccessful because of unsatisfactory accuracy, inefficiency and a high cost.

Therefore, the fact is that the ball positioning is now carried out by manual operation in many factories producing the seamed balls. However, such manual operation is apparently inefficient, labor-consuming, and unsatisfactory in accuracy.

It is, therefore, an object of the present invention to solve the above discussed problems in positioning the seamed balls such as tennis balls.

Another object of the invention is to provide a method which enables the automatic positioning of the seamed balls.

A further object of the invention is to provide a method for automatically locating the hip center of each seamed ball on a certain imaginary axis which extends through the center of the ball, in a process for stamping or printing a certain commercial indication to a predetermined spherical surface spot of each seamed ball or in a process for measuring a compressibility of the produced seamed balls for inspection purposes.

A still further object of the invention is to provide a method for automatically locating the waist center of each seamed ball on a certain imaginary axis which extends through the center of the ball, in a process for stamping or printing a desired commercial indication at a predetermined spherical surface spot of the ball or in a process for measuring a compressibility of the produced seamed balls for inspection purposes.

The above and other objects, features and advantages of the invention will become apparent from the following description of preferred embodiments thereof taken in connection with the accompanying drawings.

According to the present invention, there is provided a method for positioning seamed balls each having an endless curved seam line which divides a whole spherical surface of the ball into a pair of identical dumbbell-like parts each having a predetermined maximum longitudinal length F and a predetermined minimum crosswise length D, the sum of such lengths F, D being equal to an entire circumference of the ball, wherein each of the dumbbell-like parts has a pair of identical round hip portions joined by a waist portion which is most reduced at its middle portion, and each of the hip portions is defined by a part of the seam line which is an arc of a spherical circle with a predetermined radius which is equal to a distance from the arc to a center of the spherical circle referred to as a hip center, which comprises steps of:

(a) supporting each of the balls so that its center is located at the origin of a three-dimensional orthogonal coordinate system consisting of two horizontal axes X, Y and one vertical axis Z;

(b) rotating the ball on the axis X (and/or Y) until an optical sensor disposed on the axis Z can specify such a particular locus that is constituted by successive points of intersection of the axis Z and the spherical surface of the ball and that intersects the seam line at four points during one full rotation of the ball thereby to provide four arcs along the locus;

(c) finding the shortest arc among the four arcs on the locus by means of the sensor and then rotating the ball on the axis X (or Y) that is perpendicular to a plane including the locus, to locate a mid point of a length of the shortest arc on the axis Z by the aid of the sensor;

(d) rotating the ball on the axis Y (or X) that extends in the plane which includes a chord subtending the shortest arc until an intersection of a bisector perpendicular to the chord and a part of the seam line subtended by the chord is located on the axis Z by the aid of the sensor;

(e) rotating the ball on the axis Y (or X) by an angle of $360R/D+F$ or $360(F-R)/D+F$ in one direction or $360(R+D)/D+F$ in the opposite direction; and (f) stopping rotation of the ball upon locating the hip center on the axis Z so that an imaginary polar axis of the ball defined by an imaginary line extending through an opposed pair of the hip center is located on the axis Z.

The invention includes a further aspect wherein the hip center thus determined is utilized to determine a waist center, whereby each of the seamed balls takes its constant position.

DESCRIPTION OF THE PREFERRED EMBODIMENTS

Referring now to the accompanying drawings, there is illustrated a tennis ball as a typical example of the seamed balls to which the method of the present invention can be applied.

As is well known, a typical tennis ball 4 is formed of a pair of known identical melton dumbbell sheets 1 joined together along their curved marginal edges 5*a* to form a three-dimensional globular shape having an endless seam line 5 appearing along the marginal edges 5*a*, which divides a whole spherical ball surface into two identical portions.

Figure 1A:
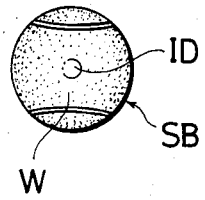
FIG. 1A is an explanatory illustration showing an example of a surface spot of a seamed ball onto which a certain commercial indication such as a trademark should be applied.
Figure 1B:
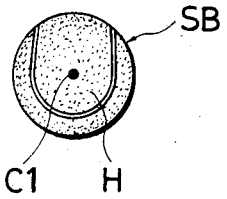
FIGS. 1B and 1C are also explanatory illustrations each showing an example of a surface spot of a seamed ball on which a certain compressive pressure should be applied during a process for inspection of compressibility of the seamed balls.
Figure 1C:
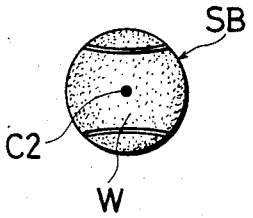
Figure 3:
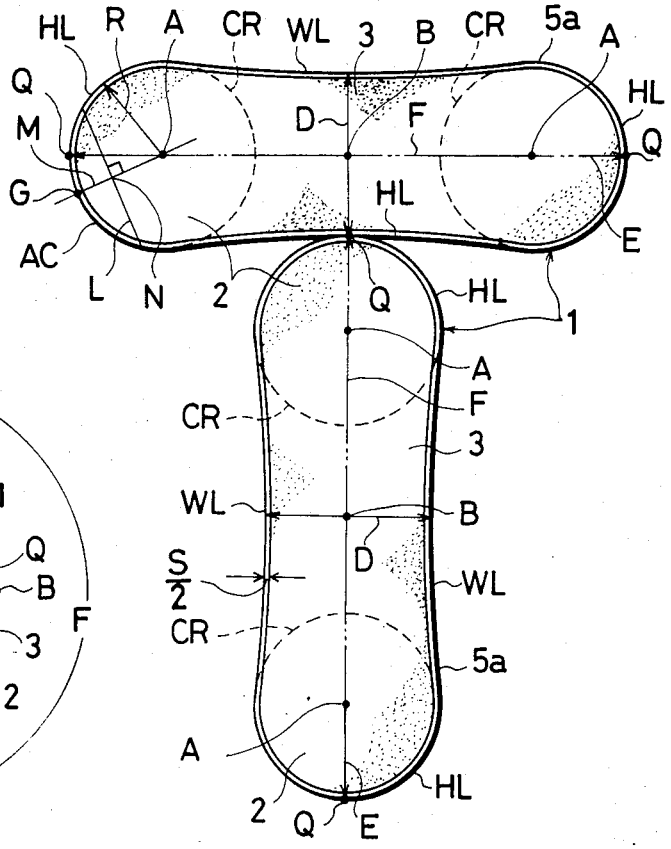
FIG. 3 is an extended elevation showing a pair of dumbbell sheets which constitute the tennis ball of FIG. 2 when joined together.
Figure 2:
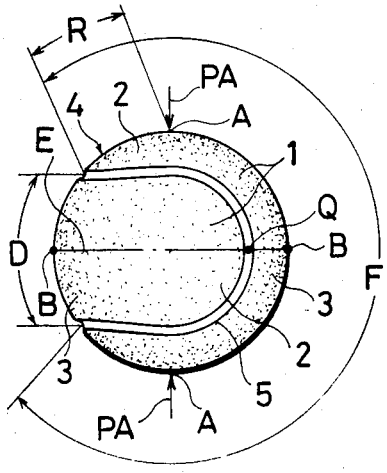
FIG. 2 is a front elevation of a tennis ball as a typical example of the seamed balls with respect to which the present invention can be applied.

Each of the pair of dumbbells 1 has a predetermined maximum longitudinal length F and a predetermined minimum crosswise length D, the sum of the length F and the length D being equal to an entire circumference of the ball, as shown in FIGS. 2 and 3. Each of the dumbbells has a pair of identical round hip portions 2 joined by a gradually reduced waist portion 3 which is most reduced at its middle portion. Thus, each tennis ball 4 has four identical hip portions 2 and two identical waist portions 3. Each of the hip portions 2 is defined by a part or arc of a spherical circle CR with a predetermined radius R, the part or arc of the spherical circle CR being hereinafter referred to as "hip line" and designated by reference character HL, while each of the waist portions 3 is defined by a pair of spaced, symmetrically concaved lines, each terminating at its opposite ends in the hip lines HL, the lines being hereinafter referred to as "waist lines" and designated by reference character WL.

Assuming that each of the four hip portions 2 has its center A, referred to as "hip center", which is a center of the spherical circle CR, and also assuming that an intermediate point between a pair of opposed hip centers A of each dumbbell 1 is designated by a reference character B as shown in FIGS. 2, 3, each of the dumbbells is provided with the following geometric properties:

(i) In each of the four hip portions 2, the radius R extends from the hip center A to terminate in the hip line HL, when viewed from the top as shown in FIG. 3.

(ii) In each of the four hip portions 2, the hip center A is always located on a perpendicular bisector M extending across a certain given chord L which subtends an arc AC as a part of the hip line HL and which intersects the chord L at its middle point N, when viewed from top as shown in FIG. 3. Naturally, the distance from the hip center A to an intersection G of the bisector M and the arc AC is equal to the radius R.

(iii) Assuming that the seamed ball 4 has an imaginary polar axis PA which extends through a pair of opposed centers A of each dumbbell 1, both of the intermediate points B of the pair of dumbbells 1 are always located on an equator E of the ball 4, as shown in FIG. 2.

Accordingly, once a certain particular chord (e.g. the chord L in the case of FIG. 3) or a certain particular arc (e.g. the arc AC in the case of FIG. 3) is given on any one of the four hip portions 2, it is possible to definitely locate the hip center A by using the given chord L or the given arc AC, in view of the above properties (i)(ii). Further, provided that one of the pair of opposed hip centers A has been thus located, the other of the pair of hip centers A and the intermediate points B can be definitely located in view of the above property (iii).

Figure 4:
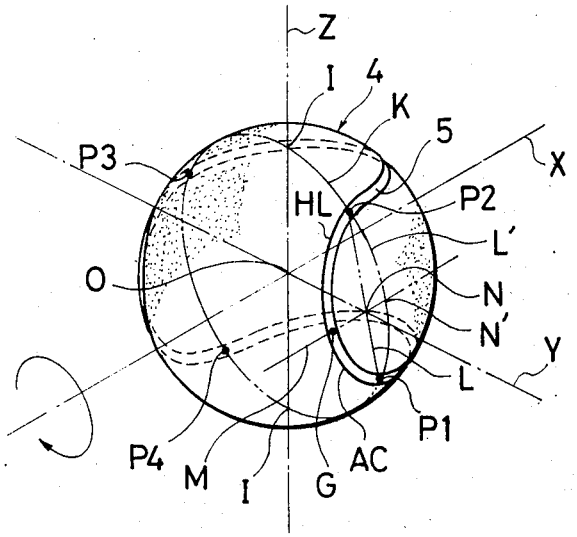
FIG. 4 is a perspective view of the tennis ball, for explaining the geometric principles on which the present invention relies.

On the other hand, the aforesaid particular chord (the chord L in FIG. 3) can be sought as follows:

Assuming that the ball 4 is rotated on a certain horizontal axis X which passes through the center O of the ball 4 (hereinafter referred to as "ball center") and that a vertical axis Z intersects the axis X at the center O at right angles, as shown in FIG. 4, a locus K, which is constituted by successive points of intersection I of the axis Z and the spherical surface of the ball 4, intersects the seam line 5 at the alternative of two or three or four points during one complete rotation of the ball 4, such number being variable in dependence upon starting positions of the ball 4.

Figure 5:
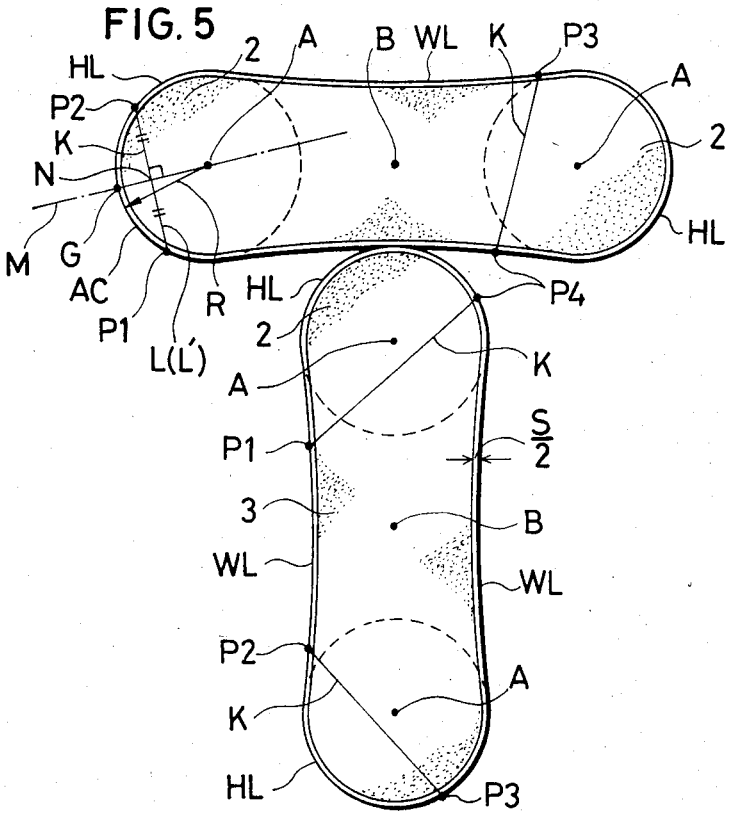
FIG. 5 is an extended elevation of FIG. 4.

For the purpose of seeking the particular chord L, it is necessary to find such a specific locus K that intersects the seam line 5 at four points P1, P2, P3, P4 as shown in FIGS. 4 and 5. Other loci which intersect the seam line 5 at two or three points during one full rotation of the ball are not utilized in the present invention. Thus, in the case where the desired locus K with four-point intersections is not found by a first one full rotation of the ball 4, it is necessary to make a second and a third additional rotation of the ball about the axis X and/or a further horizontal axis Y which intersects the axis X at the center (origin) O at right angles, in order to find the desired specific locus K.

The locus K with the four-point intersections is divided into four arcs, that is, arcs P1-P2, P2-P3, P3-P4, P4-P1, among which the shortest arc (the arc P1-P2 in FIGS. 4, 5), hereinafter generally designated by reference character L', always appears on one of the four hip portions 2 and is subtended by a chord (chord L in FIG. 4) whose opposite ends terminate in the hip line HL of the hip portion. The other arcs (arcs P2-P3, P3-P4, P4-P1 in FIGS. 4, 5) do not always appear on the hip portions 2. In the case as illustrated in FIGS. 4, 5, for example, of the arcs P2-P3, P3-P4, P4-P1 are subtended by a chord only one of whose opposite ends terminate in one hip line HL.

Thus, when the shortest arc L' is given, the chord L subtending the arc L' can be given. Naturally, the perpendicular bisector M which extends across the chord L at its middle point N can be defined, with the result that the intersection G of the bisector M and one of the hip lines HL can be sought, as shown in FIGS. 4 and 5.

Once the intersection G has thus been found, the hip center A can be determined by rotating the ball on the axis Y (or X) by an angle of 360R/D+F or 360(F-R)/D+F in one direction or 360(R+D)/D+F in the opposite direction and then stopping the rotation upon locating the center A on the axis Z. When the ball is thus positioned, an imaginary polar axis PA of the ball defined by an imaginary line extending through a pair of opposed centers A of each dumbbell is located on the axis Z.

Figure 6:
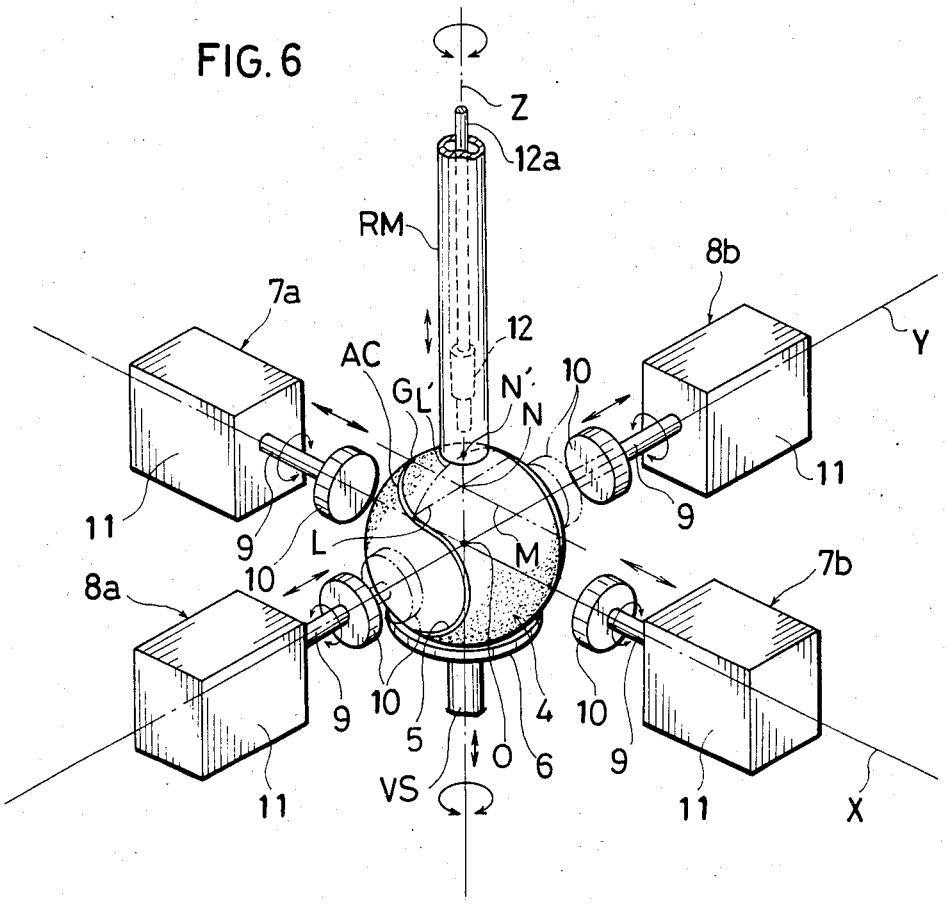
FIG. 6 is a perspective view showing a first example of the method of the invention.

FIG. 6 illustrates a first example of the method of the invention, wherein the seamed ball 4 is placed on a support member 6 so that the center O of the ball is located at the origin O of the three-dimensional orthogonal coordinate consisting of the three axes X, Y, Z.

The support member 6 may preferably be concave so that the ball can be easily and stably seated thereon. More particularly, a curvature of a spherical concaved surface wall of the support member 6 may preferably be equal to that of a spherical surface wall of the ball 4, so that both of the ball center O and the center of the support member 6 can be automatically disposed on the vertical axis Z.

The support member 6 is connected to and supported by a vertical shaft VS which extends along the axis Z and is arranged so as to be positionally adjustable up and down to locate the ball center at the origin O as described. The shaft VS may be rotatable about its own axis in opposite directions for the purpose to be described hereinafter.

In order to prevent an undesirable free movement of the ball on the support member 6, a suitable retention member is employed. The retention member may be for example a tubular member RM which extends substantially along the vertical axis Z and is movable up and down within a predetermined range so that its lower end can apply a slight pressure onto the top surface of the ball placed on the support member 6 when lowered to hold the ball in position. The retention member RM may be rotatable about its own axis in opposite directions synchronously with the support shaft VS, to cooperate with the support member 6 to hold the ball therebetween, as illustrated in FIG. 6.

The ball 4 is supported during the operation so as to be rotatable not only about the horizontal axis X but also about the horizontal axis Y. Such rotation of the ball can be realized, for example, by a pair of opposed, electronically-controlled driving units 7a, 7b disposed on the axis X and another pair of opposed, electronically-controlled driving units 8a, 8b disposed on the axis Y.

Each of the driving units 7a, 7b, 8a, 8b has a known motor (not shown) housed within a stationary casing 11. A retractable shaft 9 projects out of the casing 11 toward the ball on the support member 6 and has a disk-shaped holder 10 mounted to the forward end of the shaft 9 which may be a screw shaft connected via reduction gears to the motor so as to be axially movable back and forth as well as rotatable on its own axis not only clockwise but also counterclockwise as indicated by the arrows in FIG. 6.

Each of the driving units includes a known electronic regulator (not shown) for regulating rotational and axial motion of the retractable shaft 9 and a detector for detecting angles and direction of rotation of the shaft. The regulator and the detector may be housed within the casing 11.

A pair of the opposed shafts 9 of the driving units 7a, 7b extend on the axis X and are controlled by their respective regulators so as to be axially extended toward the ball synchronously to hold the ball therebetween and also so as to be axially retracted synchronously to release the ball. The shafts 9 are also controlled so as to be synchronously rotated in the same direction in order to rotate the ball held therebetween by a certain regulated angle about the axis X.

On the other hand, another pair of opposed shafts 9 of the driving units 8a, 8b extend on the axis Y and are controlled by their respective regulators so as to be axially extended toward the ball synchronously to hold the ball therebetween and also so as to be axially retracted synchronously to release the ball. The shafts 9 are also controlled so as to be synchronously rotated in the same direction in order to rotate the ball held therebetween by a certain regulated angle about the axis Y.

The driving units may be varied variously. For example, each of the units may be arranged so as to be axially movable and/or rotatable as a whole while the shaft 9 may be non-retractable and/or non-rotatable, if desired. Further, the retractable shaft 9 may be a piston rod which is axially moved back and forth by a hydraulic system (not shown). However, it should be noted that a particular structure per se of the driving unit and the retractable shaft is not an important feature of the invention.

A known optical sensor 12 is fixed in position on the vertical axis Z to detect the seam line 5 of the ball when the ball is rotated. For this purpose, the sensor 12 may be disposed within the hollow retention member RM and supported by a suspension rod 12a which extends upward along the axis Z for connection with an appropriate support (not shown), as illustrated in FIG. 6.

Figure 7:
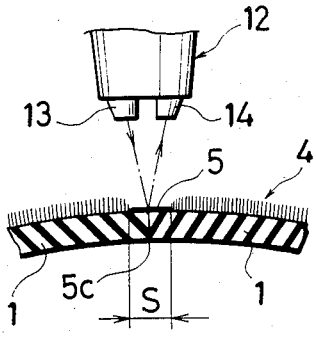
FIG. 7 is an enlarged, fragmentary, schematic illustration showing operation of an optical sensor usable for carrying out the method of the invention.

FIG. 7 illustrates an example of such optical sensor, which is a reflection type photosensor having an emitter 13 and a reflected ray detector 14. As is well known, a reflectance of the ray emitted onto the melton surface of the tennis ball and that of the ray emitted onto the seam line 5 (usually rubber) is different. Thus, it is possible to detect the seam line 5 by means of such difference in the reflectance. When the photosensor 12 detects the seam line 5, it transmits output signals to a known electronic control unit (not shown) whereby each of the driving units 7a, 7b, 8a, 8b can be automatically controlled.

Since the seam line 5 has a certain predetermined width S as indicated in FIG. 6, a center line 5C dividing the width S into two equal parts should be detected for the purpose of accuracy.

The input data obtained by the photosensor 12, such as angles of rotation of the ball, directions of rotation of the ball, the number of intersections P1, P2, P3, P4 of the axis Z and the seam line 5 (the center line 5C in a strict sense) during one full rotation of the ball, and each length of the arcs P1-P2, P2-P3, P3-P4, P4-P1, are memorized in the aforesaid electronic control unit during a series of steps for positioning one ball, whereby the driving units *7a, 7b, 8a, 8b* are automatically controlled to make a regulated rotation of the ball 4.

Figure 8:
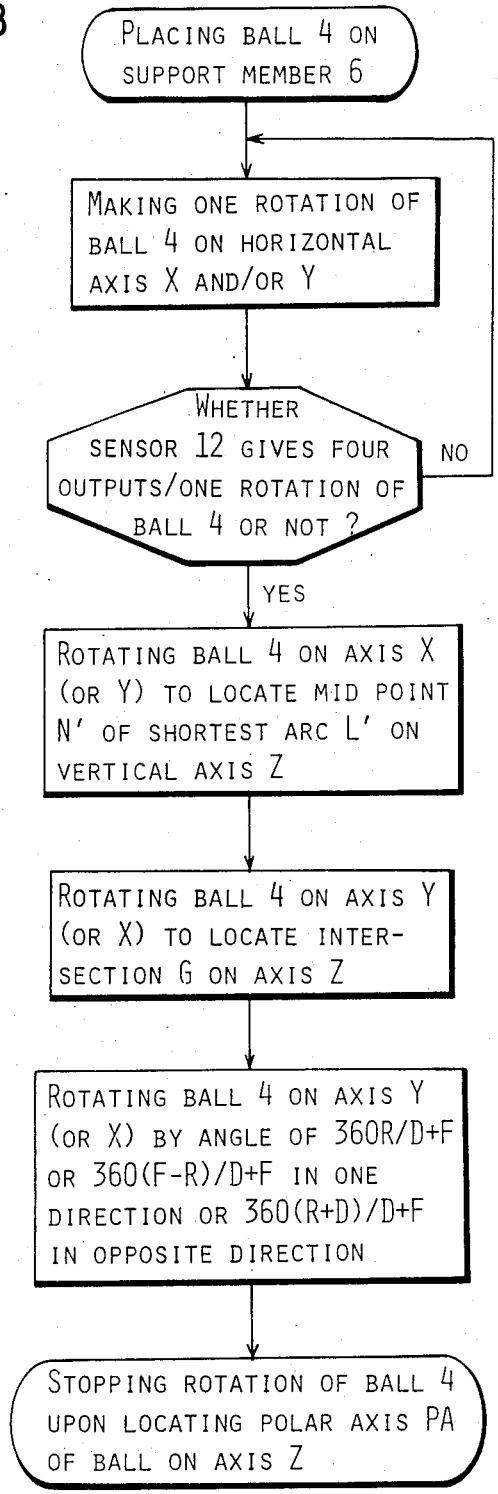
FIG. 8 is a block diagram showing the steps of the first example of the method of the invention.

Now, the steps of the invention for locating a polar axis PA of the ball 4 on the axis Z will be described with reference to FIGS. 6 and 8.

A number of seamed balls 4 are conveyed one by one from a supply source (not shown) onto the support member 6 which may preferably be positionally pre-adjusted so that the center of the ball 4, when placed thereon, is automatically located at the origin O of the three-dimensional orthogonal coordinate system consisting of the axes X, Y, Z, although the seam line 5 of the ball takes its random starting position.

Then, the ball 4 is rotated by an angle of 360° about the axis X by means of the driving units *7a, 7b* in order that the photosensor 12 can specify a particular locus K which is constituted by successive points I of intersection of the vertical axis Z and the spherical surface of the ball and which intersects the seam line 5 at four points P1, P2, P3, P4 during the rotation thereby to provide four arcs P1-P2, P2-P3, P3-P4, P4-P1 on the aforesaid locus K.

In the case where the photosensor 12 cannot give four output signals, in other words, specifies not the four points P1, P2, P3, P4 but only two or three of them during the first one complete rotation of the ball about the axis X, it is necessary to make additional rotation of the ball until the sensor 12 gives four output signals. Such additional rotation may be performed by rotating the ball about the axis Y by an angle of 360° by means of the driving units *8a, 8b*. The experiments have proved that, in the case where the sensor 12 does not give the desired four output signals as a result of the first one complete rotation of the ball about the axis X, the second one complete rotation of the ball about the axis Y will produce the desired four output signals in many cases.

In such a particular case where the four output signals are not produced as a result of the first and the second rotations about the axes X, Y, it will be necessary to make a further rotation of the ball, which may be carried out by rotating the ball about the axis X (or Y) by an angle of less than 360° and then rotating the same by an angle of 360° about the axis Y (or X). Or otherwise, in the case where the support shaft VS is rotatable about its own axis, the ball may be rotated about the vertical axis Z by an angle of other than 360° and thereafter rotated by an angle of 360° about the axis X (or Y). It has also proved by the experiments that the desired four output signals can be obtained by making such additional rotations twice at most.

When the four arcs P1-P2, P2-P3, P3-P4, P4-P1 are specified on the locus K, as shown in FIG. 4, resulting from the full rotation of the ball about the axis X, the seamed ball 4 is again rotated about the axis X by means of the driving units *7a, 7b* so that a mid point N' of the shortest arc L' (P1-P2 in FIG. 4) is located on the vertical axis Z by the aid of the sensor 12, as shown in FIG. 6.

Then, the ball 4 is rotated about the axis Y by means of the driving units *8a, 8b* until an intersection G of a bisector M perpendicular to a chord L subtending the shortest arc L' and a part or arc AC of the seam line 5 (the center line 5C in a strict sense) subtended by the chord L is located on the axis Z by the aid of the sensor 12.

Then, the ball is again rotated about the axis Y by an angle of $360\times R/(D+F)$ or $360\times(F-R)/(D+F)$ in one direction (counterclockwise in FIG. 2) or $360\times(R+D)/(D+F)$ in the opposite direction (clockwise in FIG. 2), until an opposed pair of hip centers A are located on the axis Z, where the polar axis PA of the ball passes through the hip centers A.

In the above sequential steps, the locus K having the four arcs P1-P2, P2-P3, P3-P4, P4-P1 was obtained by rotation of the ball about the axis X. However, it will be apparent that such locus may be obtained by rotation of the ball about the axis Y.

Figure 9:
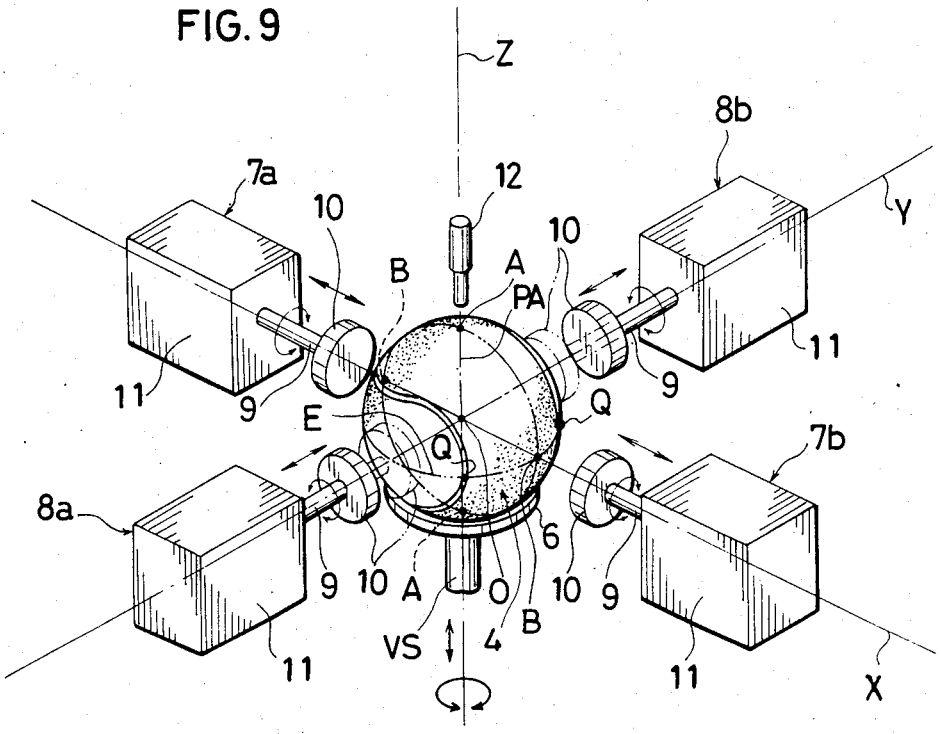
FIG. 9 is a similar view to that of FIG. 6, but showing a second example of the method of the invention.
Figure 11:
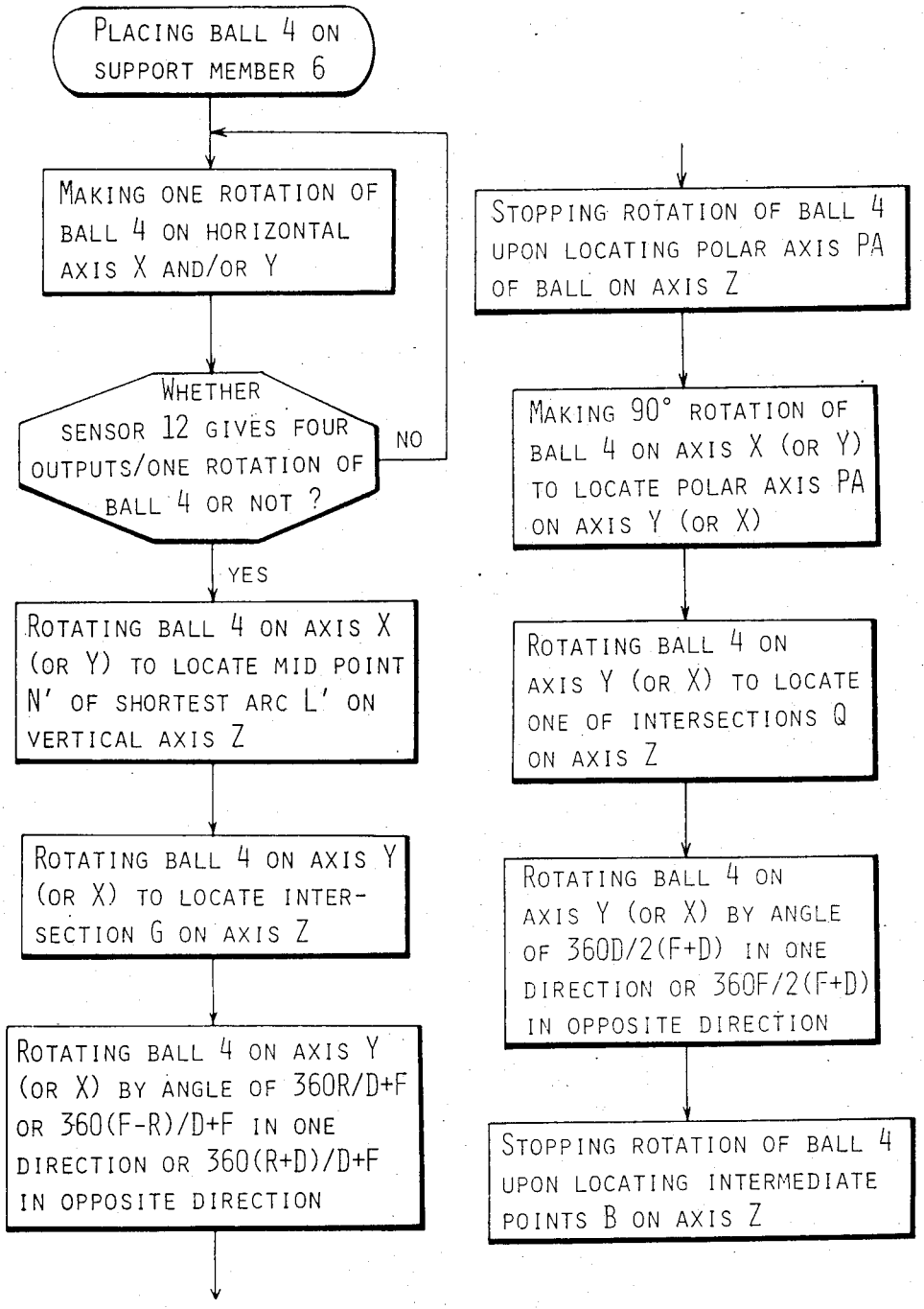
FIG. 11 is a block diagram showing the steps of the second example of the method of the invention.

FIGS. 9 and 11 illustrate a modification as the second example of the invention, which includes further steps for locating a pair of waist centers on the vertical axis Z. Each of the waist centers is defined as an intermediate point B between a pair of opposed hip centers A.

According to this second example of the invention, after the polar axis PA has been located on the vertical axis Z as illustrated in FIG. 9 by the sequential steps hereinbefore described with reference to FIGS. 2 to 8, the ball 4 is rotated by an angle of 90° about the axis X by means of the driving units *7a, 7b*, resulting in that the polar axis PA is moved onto the axis Y.

Then, the ball 4 is rotated about the axis Y by means of the driving units *8a, 8b* until one of a pair of intersections Q of the seam line 5 (strictly, the center line 5C) and an imaginary equator E of the ball is located on the axis Z by the aid of the photosensor 12.

Then, the ball 4 is again rotated about the axis Y by an angle of $360\times D/2(F+D)$ in one direction or $360\times F/2(F+D)$ in the opposite direction by means of the driving units *8a, 8b* and with the aid of the sensor 12, resulting in that a pair of waist centers defined as intermediate points B are located on the axis Z.

Figure 10:
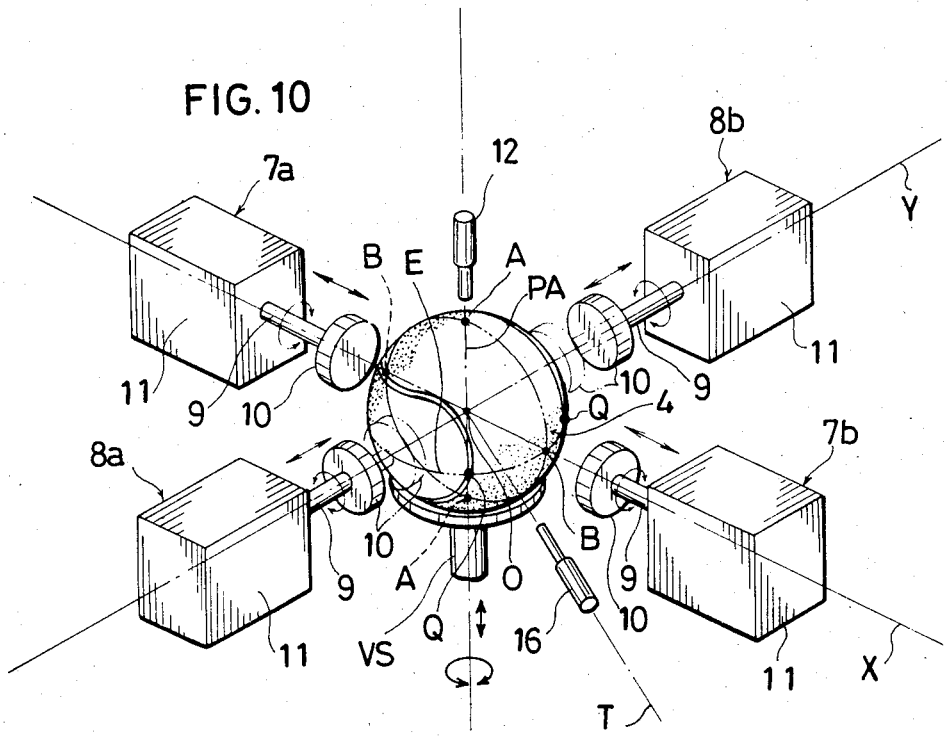
FIG. 10 is a similar view to those of FIGS. 6 and 9, but showing a third example of the method of the invention.
Figure 12:
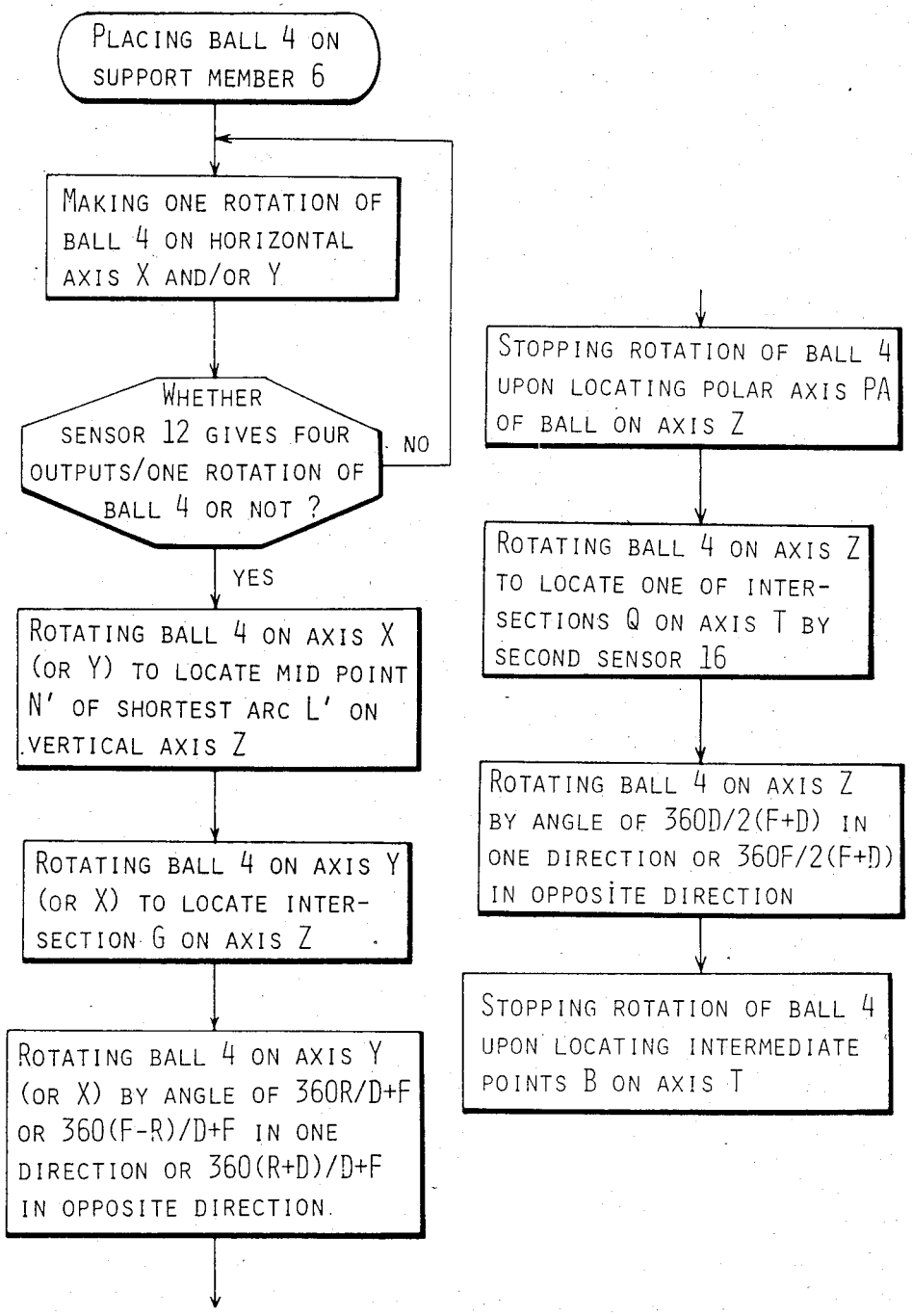
FIG. 12 is also a block diagram showing the steps of the third example of the method of the invention.

FIGS. 10 and 12 illustrate a further modification as the third example of the invention, wherein an extra photosensor 16 is utilized.

The additional sensor 16 is disposed on an extra imaginary axis T which is in the same horizontal plane as the axes X, Y and passes through the origin O, that is the center of the ball 4 placed on the support member 6, as illustrated in FIG. 10.

According to this third example of the invention, after the polar axis PA has been located on the vertical axis Z as illustrated in FIG. 10 by the sequential steps hereinbefore described with reference to FIGS. 2 to 8, the ball 4 is rotated about the axis Z as the result of synchronous rotation of the support member 6 and the retention member RM, with its lower end slightly pressed against the top surface of the ball placed on the support member, until one of the pair of the aforedescribed intersections Q is located on the extra axis T with the aid of the extra sensor 16.

Then, the ball 4 is again rotated about the axis Z by an angle of $360\times D/2(F+D)$ in one direction (rightward in FIG. 10) or $360\times F/2(F+D)$ in the opposite direction (leftward in FIG. 10), resulting in that a pair of the waist centers defined as intermediate points B are located on the extra axis T.

The present invention being thus described, it will be easily understood that the axes X, Y, Z may be interchangeable in function to one another and therefore the rotation of the ball may be started with any one of the axes X, Y, Z.

Figure 13:
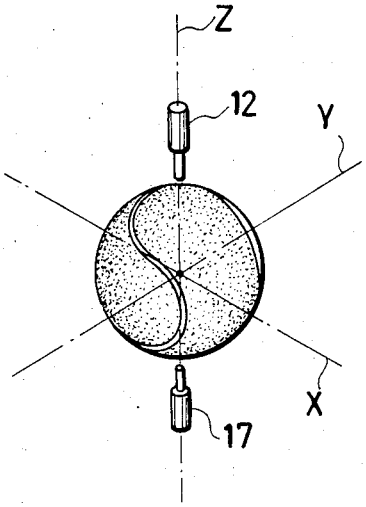
FIGS. 13 to 15 are perspective views showing modified arrangements of the optical sensors.
Figure 14:
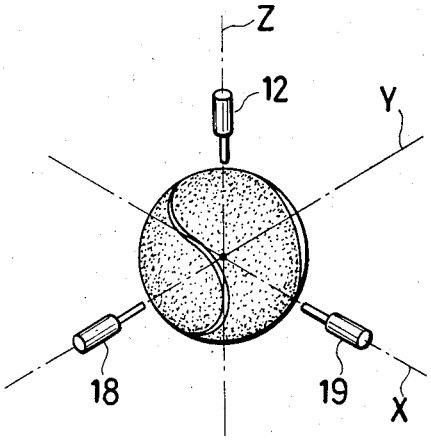
Figure 15:
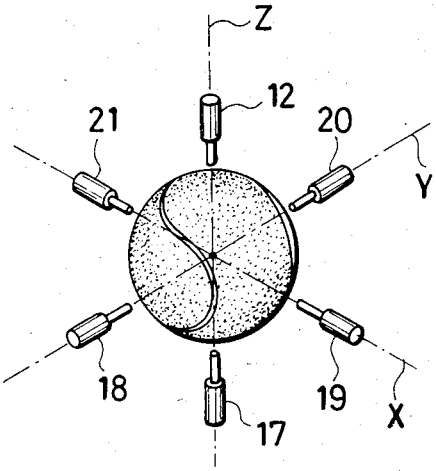

Further, the invention may be modified in many ways by various arrangement of one or more of further additional optical sensors 17, 18, 19, 20, 21, for example, as illustrated in FIGS. 13 to 15. As will be obvious to those skilled in the art, it is possible to design the driving unit utilized for the purpose described hereinbefore so that the respective additional optical sensor can be housed therein in such a manner that such additional sensor can emit its detecting rays along the axes X, Y or Z.

It will also be easily understood that, as the number of the additional sensors is increased, the degree of an angle of rotation of the ball can be decreased at some of the described sequential steps because the ball rotation can be controlled thereby so that the additional sensor can detect the nearest hip center A or the nearest waist center B and make it located on the nearest one among the three axes X, Y, Z. Further, the number of the steps per se can be minimized.

Figure 16:
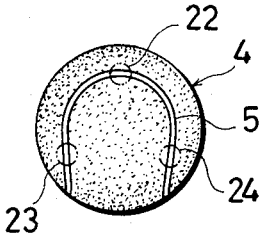
FIGS. 16 and 17 are front elevations of the seamed ball, explaining confirmatory steps to examine whether the seamed ball is properly positioned.
Figure 17:
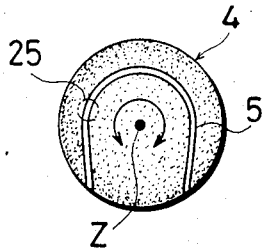

FIGS. 16 and 17 illustrate examples of arrangement of inspection optical sensors.

In FIG. 16, three stationary optical sensors 22, 23, 24 are arranged so as to detect a seam line of a ball which has been positioned by the method of the invention as described. In this case, the confirmatory step is carried out in such a manner that, if all of the three sensors 22, 23, 24 can detect existence of the seam line at three preset points to which rays are emitted from the sensors, it is confirmed that the ball is properly positioned. However, if any one or two of the sensors fail to detect existence of the seam line at such preset points, it is found that the ball is not properly positioned.

In FIG. 17, only one stationary optical sensor 25 is employed so as to detect the seam line at only one preset point. In this case the confirmatory step is quite simple.

It will be apparent to one skilled in the art that such confirmatory step may be carried out in various ways.

We claim:

1. In a method for positioning a seamed ball having an endless curved seam line which divides a whole spherical surface of said ball into a pair of identical dumbbell-like parts each having a predetermined maximum longitudinal length F and a predetermined minimum crosswise length D, a sum of said length F and said length D being equal to an entire circumference of said ball, wherein each of said dumbbell-like parts has a pair of identical round hip portions joined by a waist portion which is most reduced at its middle portion, and each of said hip portions is defined by a part of said seam line which is a part of a spherical circle with a predetermined radius which is equal to a distance from said part to a center of said spherical circle referred to as a hip center, said method comprising steps of:

(a) supporting said ball so that its center is located at an origin of a three-dimensional orthogonal coordinate system consisting of three imaginary axes, that is, a first axis, a second axis and a third axis;

(b) rotating said ball on at least one of said first and second axes until an optical sensor arranged on said third axis can detect such a particular locus that is constituted by successive points of intersection of said third axis and said spherical surface of said ball and that intersects said seam line at four points during one full rotation of said ball thereby to provide four arcs located between said four points along said locus;

(c) finding a shortest arc among said four arcs on said locus by means of said sensor and then rotating said ball on said first axis that is perpendicular to a plane including said locus to locate a mid point of said shortest arc on said third axis by the aid of said sensor;

(d) rotating said ball about said second axis that extends in said plane which includes a chord subtending said shortest arc until an intersection of a bisector perpendicular to said chord and said part of said seam line subtended by said bisector is located on said third axis by the aid of said sensor;

(e) rotating said ball about said second axis by an angle of $360R/(D+F)$ in one direction; and (f) stopping rotation of said ball, locating said hip center on said third axis so that an imaginary polar axis of said ball defined by an imaginary line extending through an opposed pair of said hip centers is located on said third axis.

2. The method as defined in claim 1, wherein, in the step (e), said ball is rotated on said second axis by an angle of $360(F-R)/(D+F)$ in said one direction.

3. The method as defined in claim 1, wherein, in the step (e), said ball is instead rotated on said second axis by an angle of $360(R+D)/(D+F)$ in a direction opposite to said one direction.

4. The method as defined in claim 1, which includes further steps of:

(g) after the step (f), rotating said ball about said first axis by an angle of 90° to locate said polar axis on said second axis;

(h) rotating said ball about said second axis so that one of a pair of intersections of said seam line and an imaginary equator of said ball is located on said third axis by the aid of said sensor;

(i) rotating said ball on said second axis by an angle of $360D/2(F+D)$ in one direction; and (j) stopping rotation of said ball, locating a waist center, which is defined as an intermediate point of a distance between said opposed pair of said hip centers, on said third axis.

5. The method as defined in claim 4, wherein, in the step (i), said ball is instead rotated on said second axis by an angle of $360F/2(F+D)$ in a direction opposite to said one direction.

6. The method as defined in claim 1, which includes further steps of:

(g) after the step (f), rotating said ball on said third axis so that one of a pair of intersections of said seam line and an imaginary equator of said ball is located on an extra imaginary axis by the aid of an additional optical sensor disposed on said extra imaginary axis which is in a plane where said first and second axes lie and which passes through said origin;

(h) rotating said ball about said third axis by an angle of $360D/2(F+D)$ in one direction;

(i) stopping rotation of said ball, locating a waist center, which is defined as an intermediate point of a distance between said opposed pair of said hip center, on said extra imaginary axis.

7. The method as defined in claim 6, wherein, in the step (h), said ball is instead rotated about said third axis by an angle of $360F/2(F+D)$ in a direction opposite to said one direction.

* * * * *